US007692591B2

(12) United States Patent
Kato et al.

(10) Patent No.: US 7,692,591 B2
(45) Date of Patent: Apr. 6, 2010

(54) PORTABLE ELECTRONIC APPARATUS

(75) Inventors: Kazuo Kato, Chiba (JP); Koichi Moriya, Chiba (JP); Shinichiro Miyahara, Chiba (JP)

(73) Assignee: Seiko Instruments Inc. (JP)

( * ) Notice: Subject to any disclaimer, the term of this patent is extended or adjusted under 35 U.S.C. 154(b) by 570 days.

(21) Appl. No.: 11/628,088

(22) PCT Filed: Apr. 27, 2005

(86) PCT No.: PCT/JP2005/007991

§ 371 (c)(1),
(2), (4) Date: Jan. 25, 2007

(87) PCT Pub. No.: WO2005/119836

PCT Pub. Date: Dec. 15, 2005

(65) Prior Publication Data

US 2009/0046020 A1 Feb. 19, 2009

(30) Foreign Application Priority Data

Jun. 3, 2004 (JP) ..... 2004-165932

(51) Int. Cl.
*H01Q 1/24* (2006.01)

(52) U.S. Cl. ..... 343/702; 343/911 R

(58) Field of Classification Search ..... 343/702, 343/911 R, 700 MS

See application file for complete search history.

(56) References Cited

U.S. PATENT DOCUMENTS 6,728,559 B2 * 4/2004 Masaki ..... 455/575.5
6,903,692 B2 * 6/2005 Kivekas et al. ..... 343/702

FOREIGN PATENT DOCUMENTS

JP 2003046311 A * 2/2003

* cited by examiner

*Primary Examiner*—Hoang V Nguyen
(74) *Attorney, Agent, or Firm*—Adams & Wilks

(57) ABSTRACT

A portable electronic apparatus has a main body case in which are disposed a display panel, a circuit board, and a dielectric antenna. The dielectric antenna is disposed at a vicinity of a peripheral edge portion of the circuit board.

23 Claims, 6 Drawing Sheets

PORTABLE ELECTRONIC APPARATUS

CROSS-REFERENCE TO RELATED APPLICATIONS

This application is a U.S. national stage application of International Application No. PCT/JP2005/007991, filed Apr. 27, 2005, claiming a priority date of Jun. 3, 2004, and published in a non-English language.

TECHNICAL FIELD

The present invention relates to a portable electronic apparatus.

BACKGROUND OF THE INVENTION

In a background art, there is conceived a portable electronic apparatus having a wireless communication function and having a mode as a wristwatch. There is such a portable electronic apparatus including a wristwatch main body, a strap for mounting the wristwatch main body to the wrist, and a helical antenna arranged at the wristwatch main body. The portable electronic apparatus is constituted such that an axial direction of the helical antenna becomes orthogonal to the wrist in order to deal with a deterioration in an antenna gain when mounted to the wrist (refer to, for example, Patent Reference 1).

Further, there is conceived a portable electronic apparatus of a background art including an electronic circuit, a display portion, and an antenna arranged at a side of the display portion, wherein the electronic circuit is surrounded by a cabinet for electromagnetic shielding. According to the portable electronic apparatus, the antenna is arranged on an outer side (on a side) of the cabinet for electromagnetic shielding (refer to, for example, Patent Reference 2).

Further, there is conceived a portable electronic apparatus of a background art arranged with an antenna in a shape of C type ring on an outer side of a wristwatch main body, wherein the antenna and a circuit at inside of the wristwatch main body are electrically connected by a feed pin (refer to, for example, Patent Reference 3).

Patent Reference 1: JP-A-11-177328

Patent Reference 2: JP-A-2000-138607

Patent Reference 3: JP-A-2000-59241

DISCLOSURE OF THE INVENTION

Problems that the Invention is to Solve

However, according to the portable electronic apparatus of the background art described in Patent Reference 1, the axial direction of the helical antenna is constituted to be orthogonal to the wrist and therefore, the portable electronic apparatus is thickened by a length in the axial direction of the helical antenna. Further, according to the portable electronic apparatus described in Patent Reference 1, a printed board for the antenna and a main printed board are connected orthogonally to each other and therefore, there also poses a problem of bringing about an increase in a number of mounting and fabricating steps.

Further, according to the portable electronic apparatus described in Patent Reference 2, the antenna is arranged on the outer side of the cabinet including the display portion and the electronic circuit, the antenna is arranged at the side of the display portion and therefore, there poses a problem that a planar size becomes large to bring about a restriction in view of design.

Further, the portable electronic apparatus described in patent Reference 3 is constituted by a structure in which the wristwatch main body is penetrated by the feed pin and therefore, a waterproof structure surrounding the feed pin becomes complicated. Further, according to the portable electronic apparatus described in Patent Reference 3, electric charge by static electricity is easy to invade inside of the wristwatch main body by way of the feed pin and therefore, there also poses a problem that the electrostatic resistance becomes disadvantageous.

The invention has been carried out in view of such a situation and it is an object thereof to provide a portable electronic apparatus having a wireless communication function and a portable electronic apparatus capable of making an outlook shape compact (e.g., having a small outer appearance).

Further, it is an object of the invention to provide a portable electronic apparatus having a wireless communication function and a portable electronic apparatus capable of avoiding a thickness in an outlook shape from being increased, capable of avoiding a number of fabricating steps from being increased, and capable of avoiding a planer size in an outlook shape from being increased.

Further, it is an object of the invention to provide a portable electronic apparatus having a wireless communication function and a portable electronic apparatus capable of avoiding a waterproof performance and electrostatic resistance from being hampered.

Means for Solving the Problems

The invention supplies the following means in order to resolve the above-described problem.

A portable electronic apparatus of the invention is characterized in that a dielectric antenna, a display panel, and a circuit board are arranged at least at inside of a main body case, the dielectric antenna is arranged at a vicinity of a peripheral edge portion of the circuit board. According to the portable electronic apparatus according to the invention, the dielectric antenna is used and therefore, it is not necessary to erect an antenna axis orthogonally to the circuit board, and a thickness in an outlook shape can be reduced. Further, the dielectric antenna can be mounted by making a solder reflow similar to a face mounting part of a chip resistor or the like and therefore, a number of fabricating steps can be reduced.

Further, according to the portable electronic apparatus according to the invention, the dielectric antenna is arranged at inside of the main body case and therefore, a path of invasion of static electricity from outside to inside of the portable electronic apparatus is eliminated, and electrostatic resistance can be promoted. Further, according to the portable electronic apparatus according to the invention, a constituent element penetrated through the main body case can be eliminated and therefore, also waterproof performance can easily be maintained equivalently to a wristwatch of a background art.

Further, according to the portable electronic apparatus according to the invention, the dielectric antenna, the display panel and the circuit board are arranged at inside of the same main body case and therefore, the outlook shape can easily be made to be compact. That is, the invention can easily make the outlook shape (planer size and thickness) compact more than a portable electronic apparatus of a background art arranged with an antenna at outside of a main body case. Further, according to the invention, the dielectric antenna is arranged at the vicinity of the peripheral edge portion of the circuit board and therefore, it can simply be avoided that an adverse influence is effected on the circuit board by a transmitting/receiving radio wave, and it can simply be avoided that an adverse influence is effected on the circuit board by the transmitting/receiving radio wave.

Further, the portable electronic apparatus of the invention is characterized in that the display panel is arranged to overlap the circuit board, and the dielectric antenna is arranged between the display panel and the circuit board.

According to the portable electronic apparatus according to the invention, the dielectric antenna is arranged right below the display panel and therefore, a planer size thereof can be downsized to be equivalent to a wristwatch size of a background art and design performance can be promoted. Further, according to the portable electronic apparatus of the invention, the planer size can be reduced while maintaining a display area of the display panel.

Further, the portable electronic apparatus of the invention is characterized in that a wiring region constituting a region of the circuit board formed with a wiring pattern is arranged not to overlap the dielectric antenna, and an end side of the wiring region and an end side of the dielectric antenna are arranged to be proximate to each other.

According to the portable electronic apparatus according to the invention, it can be avoided that a signal passing the wiring pattern of the circuit board is effected with an influence of an electromagnetic wave transmitted/received to and from the dielectric antenna while constructing a compact constitution. Further, it can also be avoided that an electromagnetic wave transmitted/received to and from the dielectric antenna is absorbed by the wiring pattern while constructing the compact constitution.

Further, the portable electronic apparatus of the invention is characterized in that the dielectric antenna comprises a ceramic element member in a shape of a rectangular parallelepiped comprising at least one dielectric layer, an antenna element comprising a dielectric member in a strip-like shape provided at the dielectric layer, a plurality of terminals provided at an outer surface of the ceramic element member, a feed terminal constituting one of the terminals and connected to a feed point of the antenna element, and a ground terminal constituting one of the terminals and connected to a ground point of the antenna element, wherein one end of the conductive member in the strip-like shape constituting the antenna element is made to constitute an open end which does not constitute the feed point and the ground point.

According to the portable electronic apparatus according to the invention, a constituted part can be constituted by the dielectric antenna which is compact and is provided with a high function antenna characteristic. Further, according to the portable electronic apparatus according to the invention, an axial direction of the dielectric antenna (longitudinal direction of the ceramic element member in the shape of the rectangular parallelepiped) and a plane of the circuit board can be arranged to be in parallel with each other and therefore, a thickness in the outlook shape can be avoided from being increased.

Further, the portable electronic apparatus of the invention is characterized in that the antenna element of the dielectric antenna is an antenna element constituting an inverse F-type antenna.

According to the portable electronic apparatus according to the invention, a constituent part thereof can be constituted by the dielectric antenna which is further compact and is provided with a higher function antenna characteristic. Here, the inverse F-type antenna element refers to an antenna in which a conductive member in a strip-like shape is meandered to fold back to be connected to constitute a shape of a rectangular wave, and a feed point and a ground point are arranged at the same side of the ceramic element member in the shape of the rectangular parallelepiped.

Further, the portable electronic apparatus of the invention is characterized in that the wiring region of the circuit board is not provided at a region in correspondence with a direction of directing a terminal end to an open end of the dielectric antenna and a region overlapping the region.

According to the portable electronic apparatus according to the invention, a directivity of the antenna can be provided in a direction directing from the terminal end to the open end of the dielectric antenna. Hence, according to the invention, an electromagnetic wave transmitted/received to and from the dielectric antenna is propagated in the region other than the wiring region of the circuit board. Therefore, it can be avoided that a transmitting and receiving electromagnetic wave effects an influence on the circuit board and the electromagnetic wave is effected with an influence from the circuit board while making wiring regions of the dielectric antenna and the circuit board proximate to each other.

Further, the portable electronic apparatus of the invention is characterized in that an inner layer of the circuit board is provided with a conductive film to overlap substantially a total of the wiring region.

Further, the portable electronic apparatus of the invention is characterized in that the conductive film constitutes a ground of the circuit board.

According to the portable electronic apparatus according to the invention, a so-to-speak ground plane (solid ground) can be constituted by the conductive film provided at the circuit board. Hence, crosstalk between signal lines interposing the conductive film can be avoided.

Further, the portable electronic apparatus of the invention is characterized in that the conductive film is arranged not to overlap the dielectric antenna.

According to the portable electronic apparatus according to the invention, it can be avoided that an electromagnetic wave transmitted/received to and from the conductive antenna is absorbed by the conductive film.

Further, the portable electronic apparatus of the invention is characterized in that the feed terminal of the dielectric antenna is arranged at one side face in a longitudinal direction of the ceramic element member in the shape of the rectangular parallelepiped, and a portion of a peripheral edge portion of the conductive film of the circuit board is formed to be in line with one side face of the dielectric antenna.

Further, the portable electronic apparatus of the invention may be constructed by using a constitution in which the portion of the peripheral edge portion of the conductive film of the circuit board is formed in a linear shape.

According to the invention, there can be provided the portable electronic apparatus which is compact and is provided with a high function wireless communication function while constructing a constitution easy to design and fabricate.

Further, the portable electronic apparatus of the invention is characterized in that the conductive film is electrically connected to the ground terminal of the dielectric antenna.

According to the portable electronic apparatus according to the invention, the conductive film functions as a ground for grounding an inverse-F type antenna. Thereby, a radio wave is efficiently radiated from the dielectric antenna.

Further, the portable electronic apparatus of the invention is characterized in that the conductive film is not arranged at the region in correspondence with the direction directing from the terminal end to the open end of the dielectric antenna and the region overlapping the region.

According to the portable electronic apparatus according to the invention, even when the dielectric antenna is arranged at the vicinity of the conductive film, an electromagnetic wave transmitted/received to and from the dielectric antenna can be avoided from being absorbed by the conductive film.

Further, the portable electronic apparatus of the invention is characterized in that the circuit board is at least provided with an information processing circuit for processing information, and a transmitting/receiving circuit (RF circuit) for inputting/outputting a signal to and from the information processing circuit and inputting/outputting a wireless signal to and from the dielectric antenna, and the transmitting/receiving circuit is arranged between the information processing circuit and the dielectric antenna.

According to the portable electronic apparatus according to the invention, the information processing circuit (MPU or the like) which is easy to be effected with an influence of electromagnetic wave noise and the dielectric antenna constituting a source of generating the electromagnetic wave noise are arranged at positions as remote as possible. Hence, the invention can provide the portable electronic apparatus without being operated erroneously while making the apparatus compact.

Further, the portable electronic apparatus of the invention is characterized in that the transmitting/receiving circuit is constituted to input/output a signal communicated by a wireless communication by utilizing a radio wave of a frequency band which a user can freely use without a license (Bluetooth module).

Further, the portable electronic apparatus of the invention is characterized in further comprising a battery arranged at inside of the main body case, wherein the battery is arranged at a position which does not overlap the dielectric antenna. It is preferable that the battery is arranged at a position overlapping the conductive film.

According to the portable electronic apparatus according to the invention, it can be avoided that an electromagnetic wave transmitted/received to and from the dielectric antenna is effected with an influence of the battery.

Further, the portable electronic apparatus of the invention is characterized in that the battery is arranged on a side opposed to a side of a face of the circuit board arranged with the dielectric antenna.

According to the portable electronic apparatus according to the invention, the circuit board is arranged to be interposed by the dielectric antenna and the battery and therefore, the planer size can be downsized to be equivalent to a wristwatch size of a background art. Further, a conductive film (ground plane) of an inner layer of the circuit board is arranged between the dielectric antenna and the battery and therefore, it can be avoided that the battery effects an influence on a characteristic of the dielectric antenna.

Further, the portable electronic apparatus of the invention is characterized in further comprising a piezoelectric buzzer arranged at inside of the main body case, wherein the piezoelectric buzzer is arranged at a position which does not overlap the dielectric antenna. It is preferable that the piezoelectric buzzer is arranged at a position overlapping the conductive film.

According to the portable electronic apparatus according to the invention, it can be avoided that an electromagnetic wave transmitted/received to and from the dielectric antenna is effected with an influence of the piezoelectric buzzer.

Further, the portable electronic apparatus of the invention is characterized in that the piezoelectric buzzer is arranged on a side opposed to the side of the face of the circuit board arranged with the dielectric antenna.

According to the portable electronic apparatus according to the invention, the circuit board is arranged to be interposed by the dielectric antenna and the piezoelectric buzzer and therefore, the planer size can be downsized to be equivalent to a wristwatch size of a background art. Further, a conductive film (ground plane) of an inner layer of the circuit board is arranged between the dielectric antenna and the piezoelectric buzzer and therefore, it can be avoided that the piezoelectric buzzer effects an influence on the characteristic of the dielectric antenna.

Further, the portable electronic apparatus of the invention is characterized in that the circuit board is a printed circuit board (PCB) including a board comprising an insulating material, a conductive pattern constituting a wiring provided at an exposed face or inside of the board, and an electronic part mounted to the exposed face of the board.

According to the portable electronic apparatus of the invention, downsizing and a reduction in fabrication cost can be achieved while providing a wireless communication function.

Further, the portable electronic apparatus of the invention is characterized in further comprising a switch, and a switch electrode and a ground electrode comprising two electrodes provided at the circuit board for connecting a switch signal outputted from the switch to the information processing circuit, the switch electrode and the ground electrode are arranged at vicinities of the dielectric antenna, the ground electrode is connected to a ground portion of the circuit board, and the ground electrode is arranged to be more proximate to the dielectric antenna than the switch electrode.

According to the portable electronic apparatus according to the invention, an influence on a wireless signal by operating the switch can be reduced while arranging the switching electrodes (switch electrode and ground electrode) at the vicinity of the dielectric antenna.

Further, the portable electronic apparatus of the invention is characterized in that the main body case includes an openable/closable lid portion, and a face of the circuit board opposed to the lid portion is provided with an inspecting connector having a terminal electrically connected to an output end of the transmitting/receiving circuit.

According to the portable electronic apparatus according to the invention, a plug of a measuring instrument or the like can be connected to the inspecting connector by only opening the lid portion of the main body case just ahead of finishing in a fabricating step. Therefore, a wireless inspection for confirming the output signal of the transmitting/receiving circuit or the like can efficiently be carried out under a condition extremely near to a mode of using the portable electronic apparatus.

Further, the portable electronic apparatus of the invention is characterized in that the display panel is constituted by including either of a liquid crystal display panel, an organic electroluminescence display panel and a plasma display panel.

Further, the portable electronic apparatus of the invention is characterized in that the display panel is constituted by including a liquid crystal display portion, a backlight portion for irradiating light to the liquid crystal display portion, and a shield plate provided at the backlight portion is not arranged at least at the region overlapping the dielectric antenna and the region in correspondence with the direction of directing from the terminal end to the open end of the dielectric antenna.

According to the portable electronic apparatus according to the invention, it can be avoided that the electromagnetic wave transmitted/received is effected with an influence from the backlight portion while making the dielectric antenna and the backlight portion proximate to each other.

Further, the portable electronic apparatus of the invention is characterized in that a conductive material is not arranged at the region disposed in the direction of directing from the terminal end to the open end of the dielectric antenna and the region overlapping the region constituting a reference by a position of the dielectric antenna.

According to the portable electronic apparatus according to the invention, it can considerably be reduced that an electromagnetic wave transmitted/received to and from the dielectric antenna is effected with an adverse influence from a constituent element of the portable electronic apparatus and the electromagnetic wave effects an adverse influence on the constituent element of the portable electronic apparatus.

Further, the portable electronic apparatus of the invention is characterized in having a function and a constitution as a wristwatch.

According to the invention, the compact portable electronic apparatus having a wristwatch function and a wireless communication function can be provided at low cost.

Further, the portable electronic apparatus of the invention is characterized in further comprising adjusting means for adjusting a frequency characteristic of the dielectric antenna, wherein the adjusting means adjusts the frequency characteristic of the dielectric antenna to be a desired value in a state of mounting the portable electronic apparatus having the function and the constitution as the wristwatch to a circular column shape member constituted by including a liquid-like member.

According to the portable electronic apparatus according to the invention, for example, in determining a constant of a matching element with regard to the dielectric antenna, the circular column shape member constituted by including the liquid-like member can be used in place of the wrist of the human body. Thereby, when the portable electronic apparatus is mounted to the wrist, a reduction in a wireless propagating distance by an influence of the human body can be reduced.

DETAILED DESCRIPTION OF THE PREFERRED EMBODIMENTS

An explanation will be given of a portable electronic apparatus according to the invention in reference to the drawings as follows. According to the embodiment, an explanation will be given by taking an electronic apparatus of a wristwatch type having a function and a constitution as a wristwatch as an example of a portable electronic apparatus.

Figure 1:
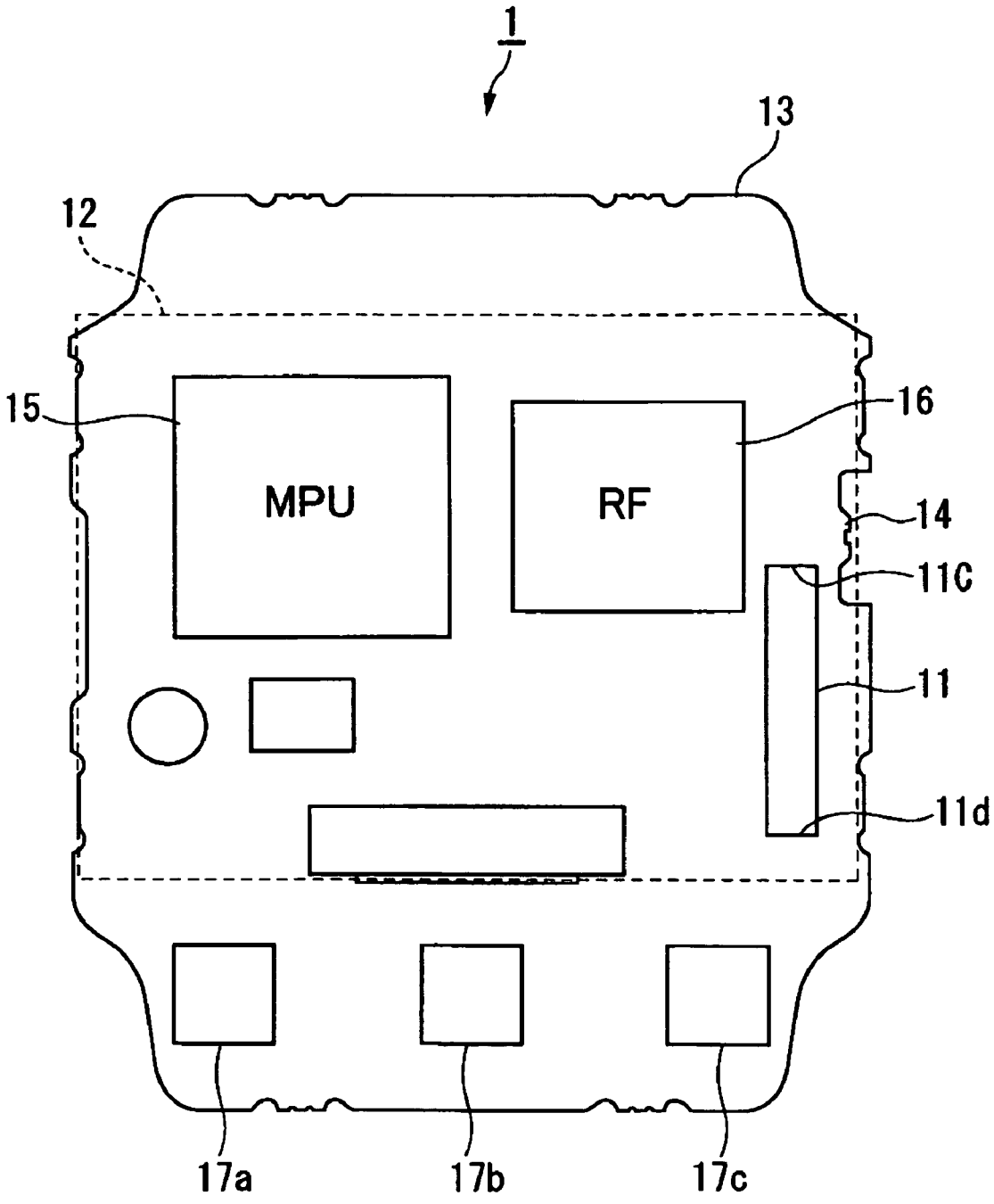
FIG. 1 is a plane view showing an essential constitution of a portable electronic apparatus according to an embodiment of the invention.
Figure 2:
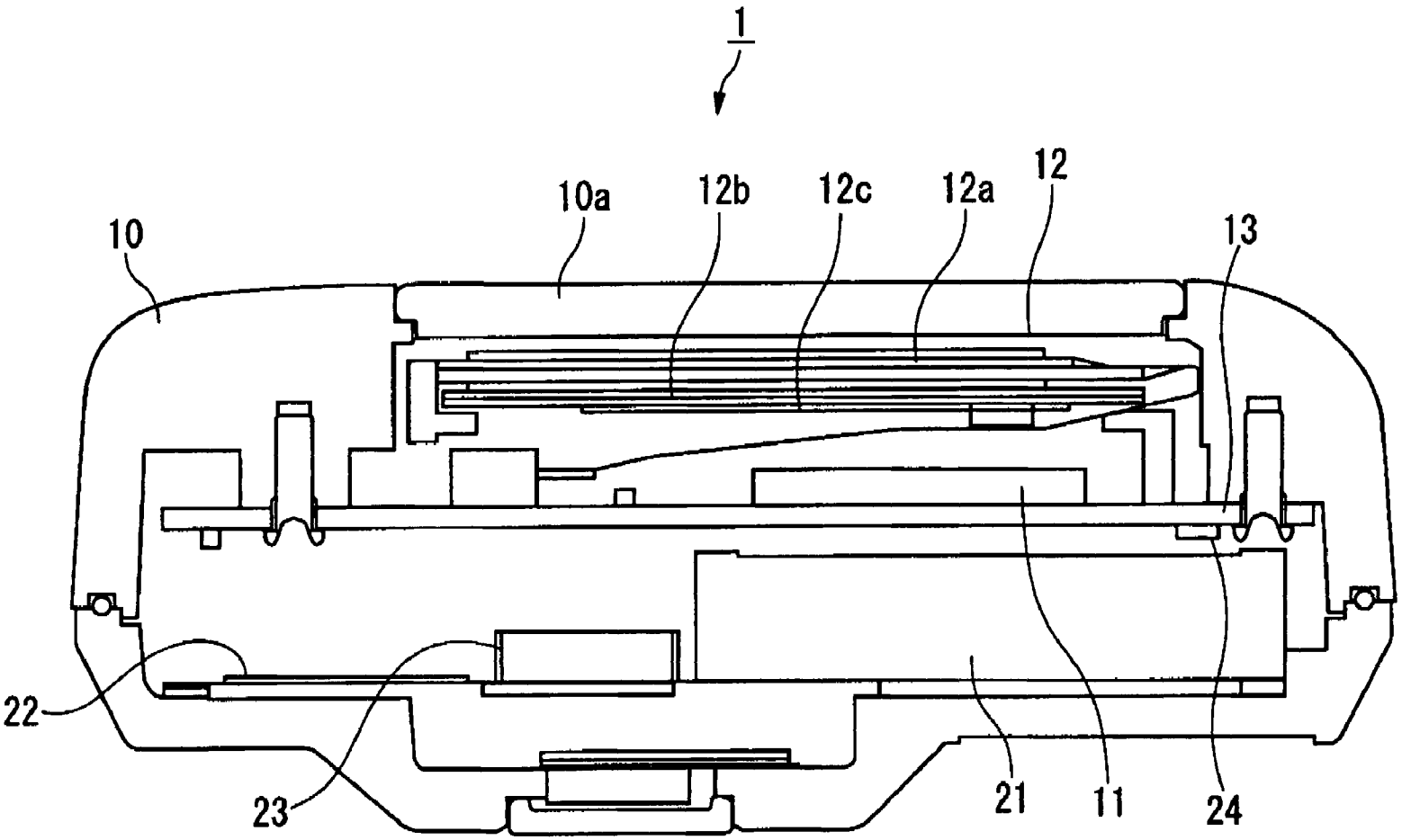
FIG. 2 is a sectional view of the portable electronic apparatus.

FIG. 1 is a plane view showing an essential constitution of a portable electronic apparatus according to the embodiment of the invention. FIG. 2 is a sectional view of the portable electronic apparatus shown in FIG. 1. FIG. 1 shows a plane view of the portable electronic apparatus at inside of a main body case (exterior case).

The portable electronic apparatus 1 is constituted by including an exterior case 10 constituting a main body case, a dielectric antenna 11, a display panel 12, and a circuit board 13. The dielectric antenna 11, the display panel 12 and the circuit board 13 are arranged at inside of the exterior case 10. Further, the dielectric antenna 11 is attached to a surface of the circuit board 13, and is arranged at a vicinity of a peripheral edge portion of the circuit board 13 (in 3 o'clock direction of a timepiece, for example).

As shown by FIG. 2, the display panel 12 is arranged to overlap the circuit board 12. Further, the dielectric antenna 11 is arranged between the display panel 12 and the circuit board 13. The display panel 12 is constituted by including a liquid crystal (LCD) panel 12*a* constituting a liquid crystal display portion, an EL (electroluminescence) panel 12*b* constituting a backlight portion for irradiating light to the liquid crystal panel 12*a* as back light, and a shield plate 12*c* provided at a bottom face of the EL panel 12*b*. Further, glass 10*a* is arranged on an upper side of the display panel 12. Glass 10*a* constitutes a portion of a main body case along with the exterior case 10.

The circuit board 13 is made to constitute a printed circuit plate constituted by including a plate comprising an insulating material, a conductive pattern constituting a wiring or the like provided at an exposed face or inside of the plate, and an electronic part mounted to the exposed face of the plate. A surface of the circuit board 13 is provided with MPU (Micro Processing Unit) 15 constituting an information processing circuit, a transmitting/receiving circuit (RF) 16 and switches 17*a*, 17*b*, 17*c*. The transmitting/receiving circuit 16 inputs/outputs a signal to and from MPU 15 and inputs/outputs a wireless signal to and from the dielectric antenna 11. Further, the transmitting/receiving circuit 16 is arranged between MPU 15 and the dielectric antenna 11. Further, a switch 14 is arranged at an edge in 3 o'clock direction of the circuit board 13.

MPU 15 constitutes a center processing unit (CPU) as one piece of a semiconductor chip. The transmitting/receiving circuit 16 may be constituted by a so-to-speak Bluetooth module. The Bluetooth module is a circuit capable of utilizing a Bluetooth technology for inputting/outputting a signal communicated by wireless communication by utilizing a radio wave of a frequency band which a user can freely use without a license.

Figure 3:
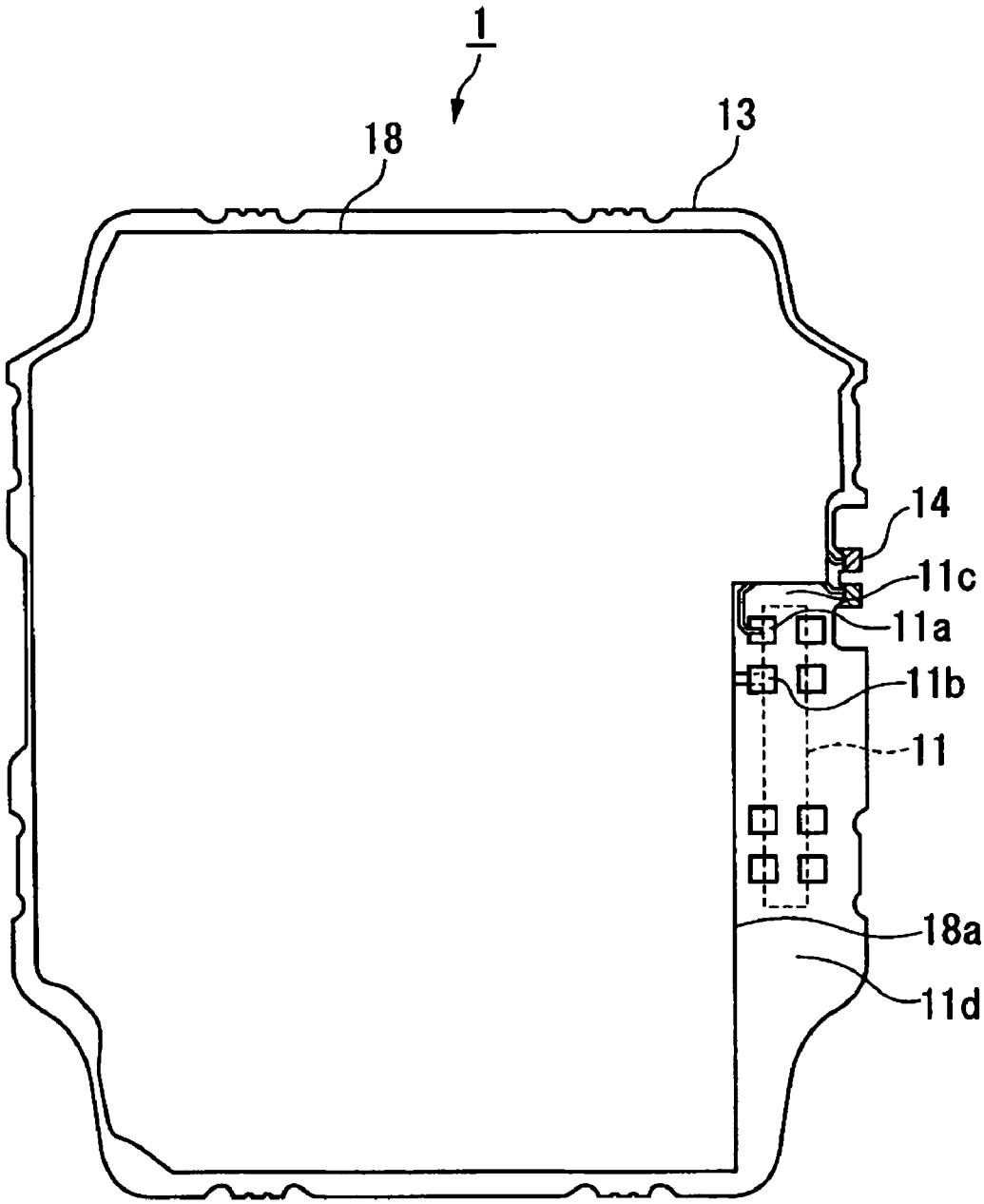
FIG. 3 is a plane view showing a wiring region and the like in a circuit board of the portable electronic apparatus.

FIG. 3 is a plane view showing a wiring region and the like in the circuit board 13. A wiring region 18 provided at a surface of the circuit board 13 is a region formed with a wiring pattern. Further, the wiring region 18 is arranged at a region which does not overlap the dielectric antenna 11. Further, an end side (peripheral edge) 18*a* of the wiring region 18 and an end side of the dielectric antenna 11 are arranged to be proximate to each other by a predetermined distance interval. According to the embodiment, the distance is 1 mm. Further, it is preferable that the wiring pattern of the end edge (peripheral edge) 18*a* of the wiring region 18 constitutes the ground of the circuit board.

The dielectric antenna 11 is constituted by including a ceramic element member in a shape of a rectangular parallelepiped comprising a plurality of dielectric layers, and an antenna element provided at the dielectric layers. The antenna element comprises a conductive member in a strip-like shape.

Further, the dielectric antenna 11 includes a feed terminal 11*a* and a ground terminal 11*b* provided at an outer surface of the ceramic element member. The feed terminal 11*a* is connected to a feed point of the antenna element. The ground terminal 11*b* is connected to a ground point of the antenna element. Further, the feed terminal 11*a* is connected to the transmitting/receiving circuit 16 by way of a matching circuit, not illustrated. The ground terminal 11*b* is connected to a conductive film (ground plane) 19 of the circuit board 13.

Further, one end of the conductive member in the strip-like shape constituting the antenna element of the dielectric antenna 11 is not provided with the feed point (feed terminal 11*a*) and the ground point (ground terminal 11*b*) but constitutes an open-end 11*d*. That is, the dielectric antenna 11 is constituted by the shape of the rectangular parallelepiped in an outlook thereof, an upper side of the end (side of arranging the feed terminal 11*a* and the ground terminal 11*b*) of the shape of the rectangular parallelepiped in FIG. 1 or FIG. 3 constitutes a terminal end 11*c* and a lower side end thereof constitutes the open end 11*d*.

Further, an antenna element of the dielectric antenna 11 is an element constituting a so-to-speak inverse F type antenna. That is, the conductive member in the strip-like shape constituting the antenna element of the dielectric antenna 11 is meandered to be folded back to be connected to constitute a shape of a rectangular wave, and the feed terminal 11*a* and the ground terminal 11*b* are arranged on the same side of the ceramic element member in the shape of the rectangular parallelepiped. Further, although the dielectric antenna 11 is provided with 6 pieces of terminals other than the feed terminal 11*a* and the ground terminal 11*b*, the 6 pieces of terminals function for only fixing the dielectric antenna 11 to the circuit board 13.

Further, as shown by FIG. 3, the wiring region 18 of the circuit board 13 is not provided at a region in correspondence with a direction of directing from the terminal end 11*c* to the open end 11*d* of the dielectric antenna 11 and a region overlapping the region.

Figure 4:
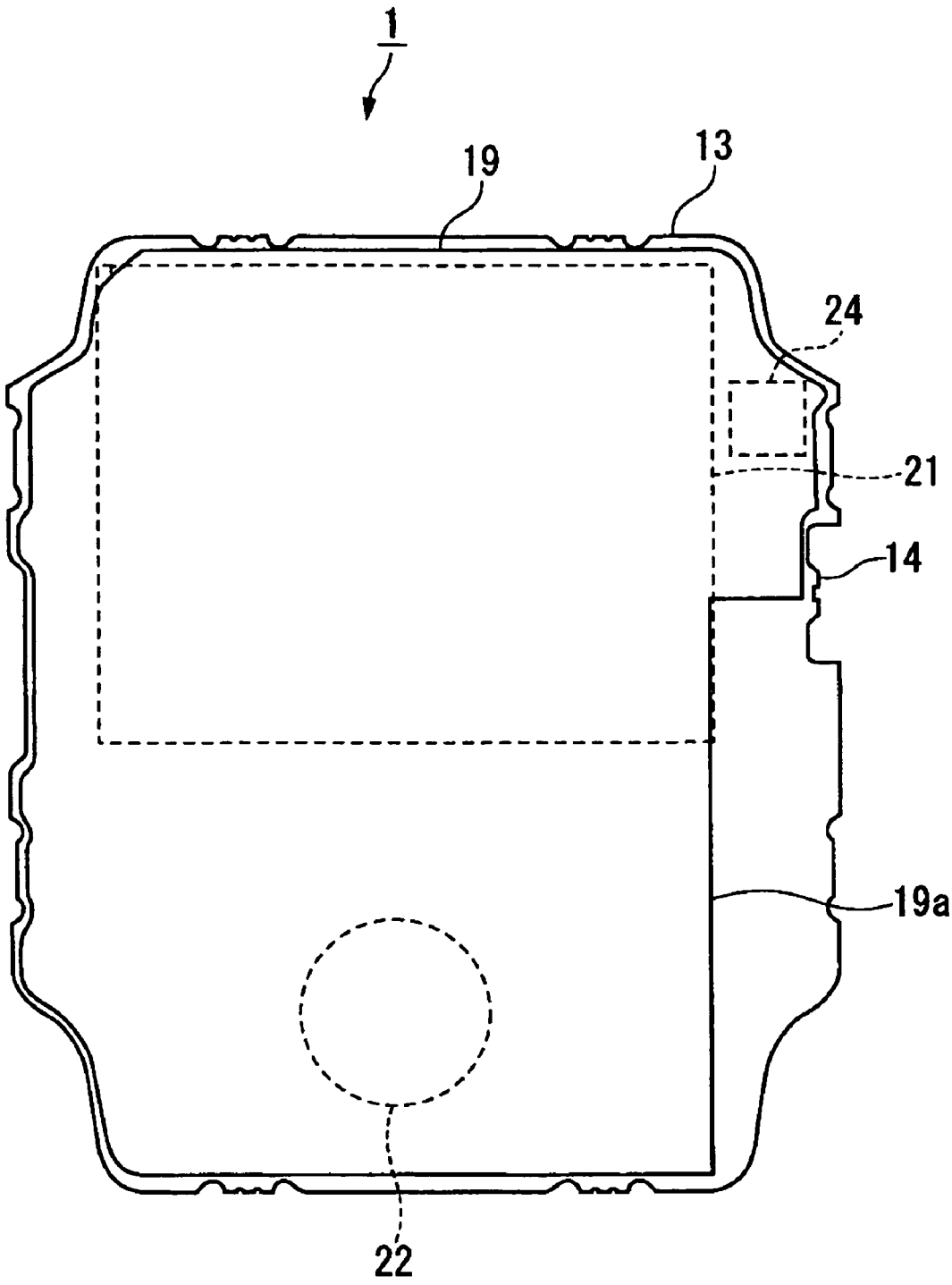
FIG. 4 is a plane view showing a conductive film and the like provided at an inner layer of the circuit board.

FIG. 4 is a plane view showing the conductive film and the like provided at the inner layer of the circuit board 13. The conductive film 19 is provided at the inner layer of the circuit board 13. The conductive film 19 constitutes a so-to-speak ground plane (solid ground). Further, the conductive film 19 is arranged to overlap substantially a total of the wiring region 18 in FIG. 3. Further, the conductive film 19 is arranged so as not to overlap the dielectric antenna 11.

In the circuit board 13, similar to the end side (peripheral edge) 18*a* of the wiring region 18, a peripheral edge portion 19*a* of a portion of the conductive film 19 is formed to be in line with one side of a side face in a longitudinal direction of the dielectric antenna 11. The peripheral edge portion 19*a* of the conductive film is formed by a linear shape to be in parallel with the side face in the longitudinal direction of the dielectric antenna 11. Further, the ground terminal 11*b* of the dielectric antenna 11 is electrically connected to the conductive film 19 by way of a through hole. The conductive film 19 functions as the ground for grounding the inverse F-type antenna and radio wave is radiated efficiently from the dielectric antenna 11.

Further, as shown by FIG. 3 and FIG. 4, the conductive film 19 is not provided at the region in correspondence with the direction of directing from the terminal end 11*c* to the open end 11*d* of the dielectric antenna 11 and the region overlapping the region. Further, it is preferable that a conductive material is not arranged at the region disposed in the direction directing from the terminal end 11*c* to the open end 11*d* of the dielectric antenna 11 and the region overlapping the region by constituting a reference by a position of the dielectric antenna 11. Hence, it is preferable that the shield plate 12*c* of the display panel 12 shown in FIG. 2 is not arranged at least at the region overlapping the dielectric antenna 11 and the region in correspondence with the direction of directing from the terminal end 11*c* to the open end lid of the dielectric antenna 11.

Further, as shown by FIG. 2 and FIG. 4, a battery 21, a piezoelectric buzzer 22 and a voltage elevating coil 23 are arranged at inside of the exterior case 10. The battery 21, the piezoelectric buzzer 22 and the voltage elevating coil 23 are arranged on a side (back face side) opposed to a side of a face (surface side) of the circuit board 13 arranged with the dielectric antenna 11. The battery 21 constitutes a power source of the portable electronic apparatus 1. Further, the battery 21 is arranged at a position which does not overlap the dielectric antenna 11. Further, the battery 21 is arranged at a position overlapping the conductive film 19 (that is, a position overlapping the wiring region 18). Further, the piezoelectric buzzer 22 is constituted by pasting together a piezoelectric ceramic thin plate (piezoelectric element) polarized in a thickness direction and a thin metal (or resin) oscillating plate. The voltage elevating coil 23 elevates a buzzer drive signal outputted from MPU 15 to a voltage of providing desired radiating sound from the piezoelectric buzzer.

Further, the piezoelectric buzzer 22 and the voltage elevating coil 23 are arranged at positions which do not overlap the piezoelectric antenna respectively. Further, also the battery 21, the piezoelectric buzzer and the voltage elevating coil 23 are arranged at positions which do not overlap each other. Further, respectives of the piezoelectric buzzer 22 and the voltage elevating coil 23 are arranged at positions overlapping the conductive film 19 (that is, positions overlapping the wiring region 18).

Thereby, since the portable electronic apparatus 1 of the embodiment uses the dielectric antenna 11, different from the portable electronic apparatus described in Patent Reference 1, it is not necessary to erect the antenna axis orthogonally to the circuit board 13. Thereby, the thickness of the portable electronic apparatus 1 can be reduced in the outlook shape. Further, the dielectric antenna 11 can be mounted to the circuit board 13 by making a solder reflow similar to a face mounting part such as a chip resistor or the like. Therefore, according to the portable electronic apparatus 1, the number of fabricating steps can be reduced.

Further, according to the portable electronic apparatus 1 of the embodiment, the dielectric antenna 11 is arranged right below the display panel 12 different from the portable electronic apparatus described in Patent Reference 2. Thereby, the portable electronic apparatus 1 can be downsized to be equivalent to a wristwatch of a background art in a planer size thereof. Therefore, according to the portable electronic apparatus 1, design performance can be promoted.

Further, according to the portable electronic apparatus 1 of the embodiment, different from the portable electronic apparatus described in Patent Reference 3, the dielectric antenna 11 is arranged at inside of the exterior case 10. Thereby, according to the portable electronic apparatus 1, a path of invasion of static electricity from outside to inside of the portable electronic apparatus 1 can simply be eliminated. Therefore, according to the portable electronic apparatus 1, electrostatic resistance can be promoted. Further, according to the portable electronic apparatus 1 of the embodiment, different from the portable electronic apparatus described in Patent Reference 3, a constituent element penetrated through the exterior case 10 can be eliminated. Hence, the portable electronic apparatus 1 can be maintained to be equivalent to the wristwatch of the background art in a waterproof performance by using a general plastic case of a timepiece of a background art as the exterior case 10.

Further, according to the portable electronic apparatus 1 of the embodiment, a conductive material is not arranged at the region overlapping the dielectric antenna 11. Further, according to the portable electronic apparatus 1, a conductive material is not arranged at the region disposed in the direction directed from the terminal end 11*c* to the open end 11*d* of the dielectric antenna 11 and the region overlapping the region by constituting the reference by the dielectric antenna 11. Thereby, it can considerably be reduced that an electromagnetic wave transmitted and received to and from the dielectric antenna 11 is effected with an adverse influence from the constituent element of the portable electronic apparatus 1 and the electromagnetic wave effects an adverse influence on the constituent element of the portable electronic apparatus 1. Therefore, the portable electronic apparatus 1 can easily be downsized while having the wireless communication function.

(Other Constitution)

Figure 5:
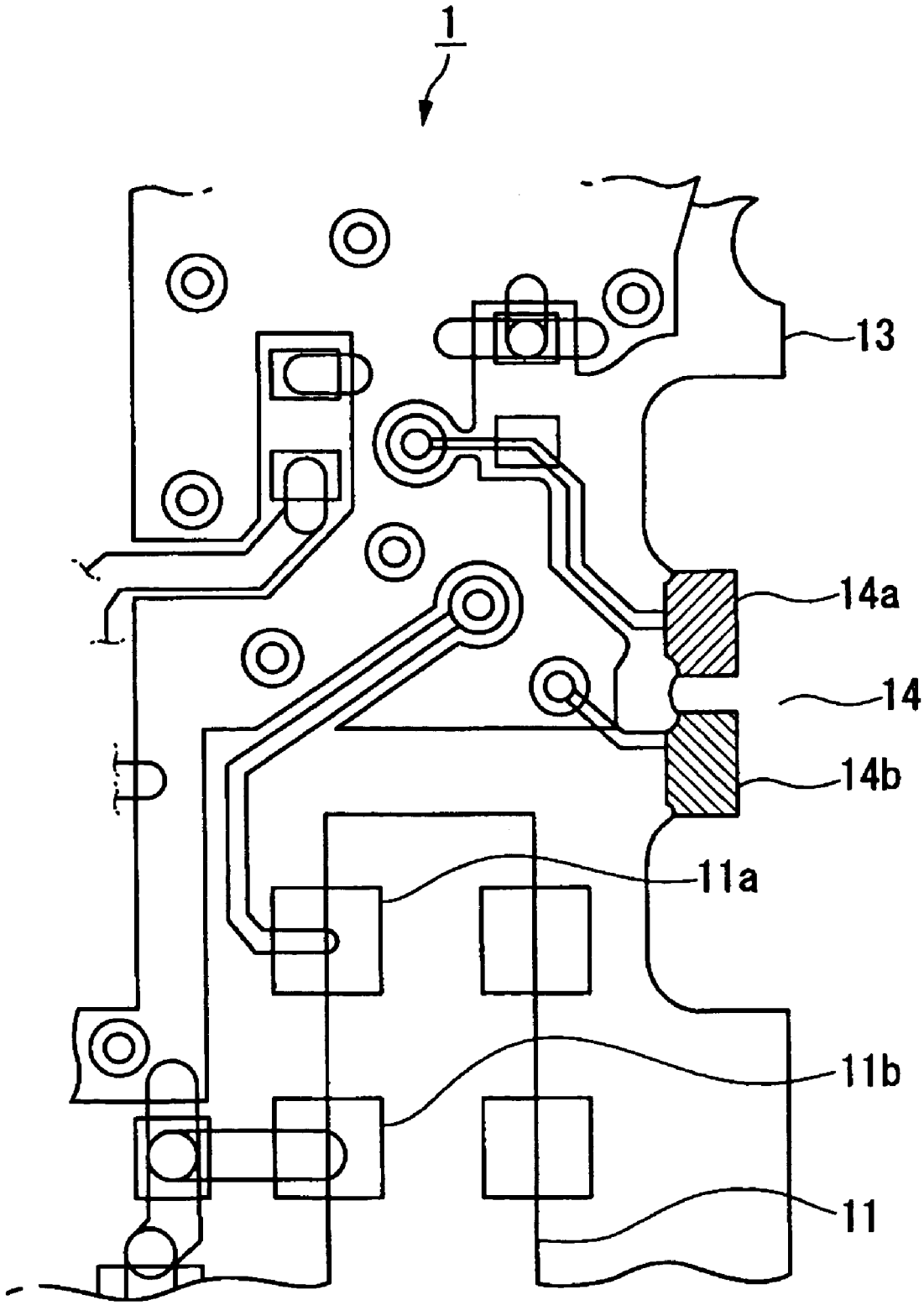
FIG. 5 is a plane view enlarging to show other characteristic portion of the portable electronic apparatus.

FIG. 5 is an enlarged plane view showing other characteristic portion of the portable electronic apparatus 1 of the embodiment. That is, FIG. 5 shows a periphery of the switch 14 in the circuit board 13 of the portable electronic apparatus 1. The switch 14 is constituted by including two electrodes of a switch electrode 14*a* and a ground electrode 14*b*. A switch signal is generated by whether the switch electrode 14*a* and the ground electrode 14*b* are short-circuited. In other words, the switch electrode 14*a* and the ground electrode 14*b* are electrodes provided at the circuit board 13 for inputting the switch signal to inside of the circuit board 13. The switch electrode 14*a* and the ground electrode 14*b* are arranged at a vicinity of the dielectric antenna 11 for downsizing or the like. The switch electrode 14*a* is connected to an input terminal of MPU 15. The ground electrode 14*b* is connected to a ground portion (conductive film 19 or the like) of the circuit board 13. Further, the ground electrode 14*b* is arranged to be more proximate to the dielectric antenna 11 than the switch electrode 14*a*.

By constructing such a constitution, while arranging the switch electrode 14*a* and the ground electrode 14*b* at vicinities of the dielectric antenna, an influence on a wireless signal by operating the switch 14 can be reduced.

Further, as shown by FIG. 2 and FIG. 4, the portable electronic apparatus 1 of the embodiment includes an inspecting connector 24. The inspecting connector 24 is a connector used in inspecting an output signal or the like of the transmitting/receiving circuit 16. Further, the inspecting connector 24 is arranged on a back face side (side opposed to a side of the dielectric antenna 11) of the circuit board 13 and includes a terminal electrically connected to an output end of the transmitting/receiving circuit 16. Further, an openable/closable lid portion (not illustrated) is provided at a portion of the exterior case 10 of the portable electronic apparatus 1 opposed to the inspecting connector 24.

By constructing such a constitution, by only opening the lid portion of the exterior case 10, the output signal of the transmitting/receiving circuit 16 can be measured by connecting a plug or the like of a measuring instrument to the inspecting connector. Therefore, according to the portable electronic apparatus 1, a wireless inspection in a state of being extremely near to an actual using state can simply and efficiently be carried out just ahead of finishing in a fabricating step.

Figure 6:
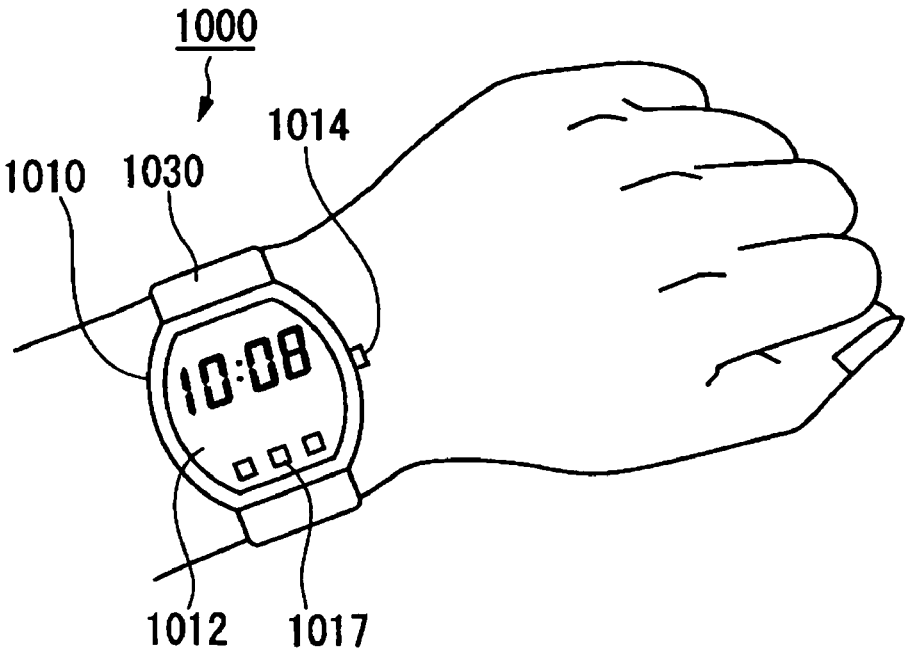
FIG. 6 is an outline view showing a state of mounting the portable electronic apparatus to the wrist.

FIG. 6 is an outline view showing a state of mounting the portable electronic apparatus 1 of the embodiment to the wrist. That is, a portable electronic apparatus 1000 in FIG. 6 shows an outlook of the portable electronic apparatus 1 shown in FIG. 1 through FIG. 5. Here, an exterior 1010 corresponds to the exterior case 10. A display portion 1012 corresponds to the display panel 12. A switch 1014 corresponds to the switch 14. A switch 1017 corresponds to the switches 17*a*, 17*b*, 17*c*. Further, the exterior 1010 is attached with a timepiece strap 1030.

Figure 7:
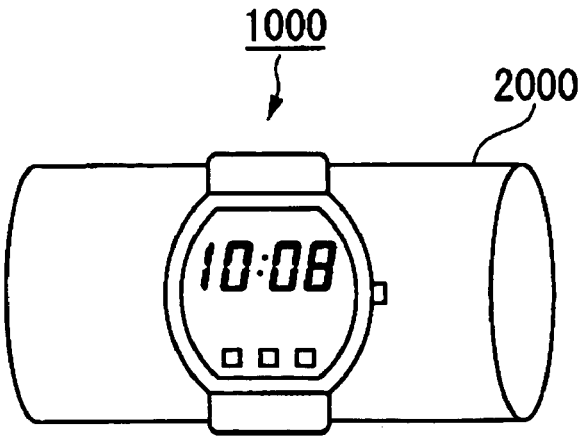
FIG. 7 is a perspective view showing an adjusting method in a step of fabricating the portable electronic apparatus.

FIG. 7 is a perspective view showing an adjusting method in a fabricating step of a portable electronic apparatus of the embodiment. Here, the portable electronic apparatus 1000 of FIG. 7 is brought into a state of being just ahead of finishing, wherein a frequency characteristic of the antenna or the like remains to be adjusted. The portable electronic apparatus 1000 is mounted to a circular column shape member 2000 constituted by including a liquid-like member.

The circular column shape member 2000 is used in determining a constant of a matching element of the antenna and constitutes adjusting means for adjusting the frequency characteristic of the dielectric antenna 11. That is, when the constant of the matching element is determined, the circular column shape member 2000 is used as a substitute for the wrist of the human body. Further, the frequency characteristic of the dielectric antenna 11 is adjusted to be a desired value in a state shown in FIG. 7.

When constituted in this way, a reduction in a wireless propagating distance by influence of the human body when the portable electronic apparatus 1000 is mounted to the wrist can be reduced.

Further, the technical range of the invention is not limited to the embodiment but can variously be changed within the range not deviated from the gist of the invention, and a specific material, a specific layer constitution or the like pointed out in the embodiment is only an example and can pertinently be changed.

For example, the portable electronic apparatus 1 according to the embodiment is not limited to the electronic apparatus of the wristwatch type but is applicable to various small-sized apparatus of, for example, PDA (Personal Digital Assistance), a portable telephone, a camera, an overhead projector, an electronic control apparatus of an automobile and the like.

Further, the display panel 12 of the portable electronic apparatus 1 of the embodiment is not limited to the liquid crystal display apparatus but the display panel 12 may be constituted by an organic EL display panel, a plasma display panel or the like.

Further, according to the embodiment, the transmitting/receiving circuit 16 is not limited to the Bluetooth module but may be constituted by, for example, a wireless LAN module, or a weak wireless module. Also as a frequency used, a frequency optimum for each country, for example, at vicinity of 300 MHz may be used in Japan, a frequency at vicinity of 900 MHz may be used in the United States of America to achieve a desired electric field intensity.

INDUSTRIAL APPLICABILITY

According to the invention, there can be provided a portable electronic apparatus having a wireless communication function and capable of easily making an outlook shape compact (e.g., having a small outer appearance).

Further, according to the invention, there can be provided a portable electronic apparatus having a wireless communication function, capable of avoiding a thickness in an outlook shape from being increased, capable of avoiding a number of fabricating steps from being increased, and capable of avoiding a planer size in an outlook shape from being increased.

Further, according to the invention, there can be provided a portable electronic apparatus having a wireless communication function and capable of easily maintaining waterproof performance and electrostatic resistance.

The invention claimed is:

1. A portable electronic apparatus comprising: a main body case; a display panel disposed in the main body case; a circuit board disposed in the main body case; and a dielectric antenna disposed in the main body case at a vicinity of a peripheral edge portion of the circuit board; wherein the display panel overlaps the circuit board, and the dielectric antenna is disposed between the display panel and the circuit board; and wherein a wiring region of the circuit board is formed with a wiring pattern disposed so as to not overlap the dielectric antenna, an end side of the wiring region and an end side of the dielectric antenna being disposed proximate one other.

2. A portable electronic apparatus according to claim 1; further comprising a battery disposed in the main body case at a position which does no overlap the dielectric antenna.

3. A portable electronic apparatus according to claim 2; wherein the battery is disposed on a side opposite to a side of a surface of the circuit board provided with the dielectric antenna.

4. A portable electronic apparatus comprising: a main body case; a display panel disposed in the main body case; a circuit board disposed in the main body case; and a dielectric antenna disposed in the main body case at a vicinity of a peripheral edge portion of the circuit board; wherein a wiring region of the circuit board is formed with a wiring pattern disposed so as to not overlap the dielectric antenna, an end side of the wiring region and an end side of the dielectric antenna being disposed proximate one other.

5. A portable electronic apparatus comprising: a main body case; a display panel disposed in the main body case; a circuit board disposed in the main body case; and a dielectric antenna disposed in the main body case at a vicinity of a peripheral edge portion of the circuit board; wherein the dielectric antenna comprises a ceramic element member having a rectangular parallelepiped shape and, at least one dielectric layer, an inverse F-type antenna element comprising a dielectric member having a strip-like shape and disposed at the dielectric layer and a plurality of terminals disposed at an outer surface of the ceramic element member, the plurality of terminals comprising a feed terminal connected to a feed point of the antenna element and a ground terminal connected to a ground point of the antenna element; wherein one end of the dielectric member forms an open end which does not constitute the feed point and the ground point.

6. A portable electronic apparatus comprising: a main body case; a display panel disposed in the main body case; a circuit board disposed in the main body case; and a dielectric antenna disposed in the main body case at a vicinity of a peripheral edge portion of the circuit board; wherein the circuit board has a wiring region comprising a wiring pattern that is not disposed at a region corresponding to an open end of the dielectric antenna.

7. A portable electronic apparatus according to claim 6; wherein an inner layer of the circuit board has a conductive film overlapping substantially the entire wiring region of the circuit board.

8. A portable electronic apparatus according to claim 7; wherein the conductive film comprises a ground of the circuit board.

9. A portable electronic apparatus according to claim 7; wherein the conductive film does not overlap the dielectric antenna.

10. A portable electronic apparatus comprising: a main body case; a display panel disposed in the main body case; a circuit board disposed in the main body case; and a dielectric antenna disposed in the main body case at a vicinity of a peripheral edge portion of the circuit board; wherein the circuit board has at least an information processing circuit for processing information, and a transmitting/receiving circuit for inputting/outputting a signal to and from the information processing circuit and inputting/outputting a wireless signal to and from the dielectric antenna, the transmitting/receiving circuit being disposed between the information processing circuit and the dielectric antenna.

11. A portable electronic apparatus according to claim 10; wherein the transmitting/receiving circuit operates to input/output a signal by wireless communication utilizing a radio wave of a frequency band which a user can freely use without a license.

12. A portable electronic apparatus comprising: a main body case; a display panel disposed in the main body case; a circuit board disposed in the main body case; a dielectric antenna disposed in the main body case at a vicinity of a peripheral edge portion of the circuit board; and a piezoelectric buzzer disposed in the main body case at a position which does not overlap the dielectric antenna.

13. A portable electronic apparatus according to claim 12; wherein the piezoelectric buzzer overlaps a conductive film that overlaps a wiring pattern on the circuit board.

14. A portable electronic apparatus according to claim 12; wherein the piezoelectric buzzer is disposed on a side opposite to a side of a surface of the circuit board provided with the dielectric antenna.

15. A portable electronic apparatus comprising: a main body case; a display panel disposed in the main body case; a circuit board disposed in the main body case; a dielectric antenna disposed in the main body case at a vicinity of a peripheral edge portion of the circuit board; and adjusting means for adjusting a frequency characteristic of the dielectric antenna to a preselected value.

16. A portable electronic apparatus according to claim 15; wherein the portable electronic apparatus comprises a wristwatch.

17. A portable electronic apparatus comprising:

a main body case;

a display panel disposed in the main body case;

a circuit board disposed in the main body case, the circuit board having a wiring pattern and a conductive film overlapping substantially the entire wiring pattern; and a dielectric antenna disposed in the main body case and at a vicinity of a peripheral edge portion of the circuit board so that the wiring pattern does not overlap the dielectric antenna.

18. A portable electronic apparatus according to claim 17; wherein the dielectric antenna comprises a ceramic element member having a rectangular parallelepiped shape and comprising at least one dielectric layer, an antenna element comprising a dielectric member having a strip-like shape and disposed at the dielectric layer, and a plurality of terminals disposed at an outer surface of the ceramic element member, the plurality of terminals comprising a feed terminal connected to a feed point of the antenna element and a ground terminal connected to a ground point of the antenna element; wherein one end of the dielectric member forms an open end which does not constitute the feed point and the ground point.

19. A portable electronic apparatus according to claim 18; wherein the feed terminal of the dielectric antenna is disposed at one side surface in a longitudinal direction of the ceramic element member; and wherein a portion of a peripheral edge portion of the conductive film of the circuit board is formed to be in line with one side surface of the dielectric antenna.

20. A portable electronic apparatus according to claim 19; wherein the portion of the peripheral edge portion of the conductive film has a linear shape.

21. A portable electronic apparatus according to claim 20; wherein the conductive film of the circuit board is electrically connected to the ground terminal of the dielectric antenna.

22. A portable electronic apparatus comprising:

a main body case;

a display panel disposed in the main body case;

a dielectric antenna disposed in the main body case; a circuit board disposed in the main body case so that the dielectric antenna is disposed at a vicinity of a peripheral edge portion of the circuit board, the circuit board having at least an information processing circuit for processing information, and a transmitting/receiving circuit for inputting/outputting a signal to and from the information processing circuit and inputting/outputting a wireless signal to and from the dielectric antenna, the transmitting/receiving circuit being disposed between the information processing circuit and the dielectric antenna;

a switch; and a pair of electrodes comprising a switch electrode and a ground electrode disposed at the circuit board for connecting a switch signal outputted from the switch to the information processing circuit, the ground electrode being connected to a ground portion of the circuit board, and the switch electrode and the ground electrode being disposed at vicinities of the dielectric antenna so that the ground electrode is disposed closer to the dielectric antenna than the switch electrode.

23. A portable electronic apparatus according to claim 22; wherein the main body case comprises an openable/closable lid portion; and further comprising an inspection connector having a terminal electrically connected to an output end of the transmitting/receiving circuit and mounted on a surface of the circuit board disposed opposite to the lid portion.

* * * * *